United States Patent [19]

Swanson

[11] 4,369,531

[45] Jan. 25, 1983

[54] LIQUID FLOW CONTROL STRAINER

[75] Inventor: Richard G. Swanson, West Hartford, Conn.

[73] Assignee: Macristy Industries, Inc., New Britain, Conn.

[21] Appl. No.: 260,085

[22] Filed: May 4, 1981

[51] Int. Cl.[3] ..... A47K 1/14

[52] U.S. Cl. ..... 4/295; 4/286; 251/75

[58] Field of Search ..... 4/286, 287, 295, 290, 4/291, 292, 293; 215/355, 358, 359–361; 251/74, 75, 103

[56] References Cited

U.S. PATENT DOCUMENTS

| | | | |
|---|---|---|---|
| 2,670,143 | 2/1954 | Jordan | 241/301 |
| 3,220,695 | 11/1965 | Downey et al. | 251/74 X |
| 3,366,980 | 2/1968 | Petursson et al. | 4/295 |
| 3,468,512 | 9/1969 | Politz | 4/295 |
| 3,949,433 | 4/1976 | Lion | 251/75 |
| 4,103,372 | 8/1978 | Cuschera | 4/295 |

*Primary Examiner*—John W. Shepperd
*Assistant Examiner*—Kenneth S. Putnam

[57] ABSTRACT

A strainer for a tub drain has a spring-biased plunger for moving the stopper from its closed position to an open, liquid flow position. The plunger has a stem that extends into the passageway of the body of the strainer, and is mounted thereon for axial reciprocation between an extended outward (open) position and a depressed inward (closed) position. An axial bore extends through the stopper member, and provides a surface portion conforming to the corresponding portion of the plunger stem. Inward movement of the plunger causes a sealing ring, which is mounted on the stem portion, to be displaced to a position of frictional engagement on the corresponding surface portion of the stopper member bore. Subsequent outward movement, under the force of the biasing spring, causes the plunger to lift the stopper member away from the seat portion of the body, and thereby to open the strainer.

16 Claims, 7 Drawing Figures

LIQUID FLOW CONTROL STRAINER

BACKGROUND OF THE INVENTION

The stopper used to retain water and other liquids in sinks, tubs and the like may range from a very simple rubber plug to a relatively complex assembly of levers and linkages through which a mounted plug member may be operated remotely. While inexpensive and effective, the simple rubber stoppers are unattractive and tend to deteriorate after periods of use; also, unless tethered, they tend to be misplaced. The mechanical assemblies, on the other hand, are relatively complex and hence expensive to manufacture; they are also somewhat inconvenient from the standpoints of installation and maintenance. Devices for direct drain installation have also been proposed, such as that which is described in Petursson et al U.S. Pat. No. 3,366,980. While avoiding some of the disadvantages of the prior art approaches, the constructions shown by Petursson et al are not of optimal simplicity, and may tend to obstruct flow excessively. Moreover, the patented device is capable of assuming only two positions (i.e., either fully open or fully closed), and thus is not capable of establishing controlled flow at rates reduced from the maximum.

Accordingly, it is an object of the present invention to provide a novel strainer for controlling liquid flow through the drain of a tub or similar vessel, which is of simple construction and consists of a minimum number of parts, and hence is relatively inexpensive and facile to manufacture.

It is also an object of the invention to provide such a strainer which operates effectively and smoothly between closed and open positions.

Another object is to provide a strainer that permits substantially unobstructed flow at rates that can readily be varied.

Yet another object of the invention is to provide a strainer having the foregoing features and advantages, which is attractive, convenient to install and operate, and can readily be disassembled for cleaning and for replacement of sealing elements, if required.

SUMMARY OF THE DISCLOSURE

It has now been found that the foregoing and related objects of the invention are attained in a strainer for installation in a drain, comprising a body, an operating plunger mounted on the body, and a stopper member slideably mounted on the plunger. The body of the strainer defines an axial passageway, and has a seat portion providing a sealing surface adjacent the inlet end thereof. The plunger has a stem that extends into the passageway of the body, and is mounted thereon for axial reciprocation between an extended outward position and a depressed inward position; means is provided for biasing the plunger to the outward position. The stopper member has a stopper aligned over the seat portion of the body for seating thereon to close the strainer, and the stopper has an outer peripheral edge portion adapted to sealingly engage the sealing surface of the body when in its seated position. An axial bore extends through the stopper member, and provides a surface portion dimensioned and configured to conform to the corresponding portion of the plunger stem. A resiliently deformable sealing ring is fixedly mounted to extend about the plunger stem portion; it is positioned inwardly of the outer end of the stem, and will preferably lie directly adjacent the stopper member bore, in sealing engagement, when the stopper and the plunger are in their seated and outward positions, respectively. As a result, the strainer may be opened from its closed condition by depressing and then releasing the plunger. Inward movement of the plunger causes the sealing ring to be displaced to a position of frictional engagement on the corresponding surface portion of the bore through the stopper member; subsequent outward movement, under the force of the biasing means, causes the plunger to lift the stopper away from the seat portion of the body and thereby to open the strainer.

In the preferred embodiments, the body of the strainer comprises a cylindrical sidewall defining the passageway therethrough, and includes a perforate end wall extending across the inner end of the sidewall. The stem of the plunger projects through the end wall and is slideably engaged therein, with means being provided on the projecting end portion thereof to prevent movement of the plunger beyond its extended position. Generally, the sidewall of the strainer body will be externally threaded to permit facile installation in a drain opening.

Most desirably, the outer end of the sidewall will terminate in an annular flange, which will lie flush with the inside surface of the vessel when the strainer is in place. The flange will normally be joined to the sidewall of the body by a circumferential transition edge portion of rounded cross-section, which will provide the seat portion and sealing surface of the strainer body.

The stopper will preferably be of generally disk-like configuration, with its circumferential edge portion beveled to provide a downwardly tapered conical surface for close seating upon the seat portion of the body. The conical surface may have a circumferentially extending groove formed therein, for mounting of a sealing ring. Most often, the bore through the stopper member will be of circular cross-section, and the corresponding portion of the plunger stem will be cylindrical; it will normally also have a circumferential groove formed therein for receiving the stem-mounted sealing ring.

In certain embodiments, the bore through the stopper member may lie substantially within the stopper. It may be of uniform cross-section along its length, and will have a diameter slightly greater than that of the corresponding portion of the plunger stem, to provide a substantially uniform gap therebetween, so as to cause the sealing ring to effect frictional binding engagement in its displaced position. Such a strainer may include a bushing rigidly affixed to and projecting from the end wall of the body, through the bore of which the stem of the plunger will extend coaxially. A sleeve element may also be affixed to the stopper for extension into coaxial, telescopic engagement over the bushing, and the latter may have an axial slot or keyway, formed in the surface defining its bore, to slideably receive a radially projecting lug provided on the stem of the plunger. The stem will thereby be locked against rotation, so as to facilitate assembly and disassembly of a head portion, which may be threadably engaged upon the outer end thereof.

A coil spring will usually serve as the biasing means, and it will suitably be mounted on the plunger shaft and within the sleeve of the stopper member. For that purpose, the portion of the shaft corresponding to the bore through the stopper member may be enlarged, to form a circumferential shoulder upon which one end of the spring may bear. The opposite end may bear upon a confronting end of the bushing attached to the end wall of the body, thus causing the spring to be compressed therebetween.

In embodiments in which the stopper member additionally includes a sleeve element, the latter will preferably at least in part define the axial bore through the stopper member, as well as the conforming surface portion thereof. Most desirably, in such a strainer, the bore will lie substantially within the sleeve element, and will be of circular cross-section, with the corresponding portion of the plunger stem being cylindrical. An annular enlargement will be formed coaxially into the sleeve element at a location spaced from its outer end, and a circumferentially constricted throat portion will be defined outwardly adjacent thereto. The throat portion will be dimensioned to compress the sealing ring, and the annular enlargement will be dimensioned to permit its substantial expansion, when the sealing ring is in respective registry therewith. As a result, the annular enlargement will provide a position of snap-fitting frictional engagement for the sealing ring, in an inwardly displaced position thereof. The bore through the sleeve element may desirably have a second constricted portion inwardly adjacent its annular enlargement, to restrain inward displacement of the plunger beyond the point of engagement of the sealing ring. It may also have an enlarged entry portion outwardly adjacent the throat portion, within which the sealing ring is expandable to substantially its full extent, to effect sealing engagement.

DETAILED DESCRIPTION OF THE ILLUSTRATED EMBODIMENT

Figure 1:
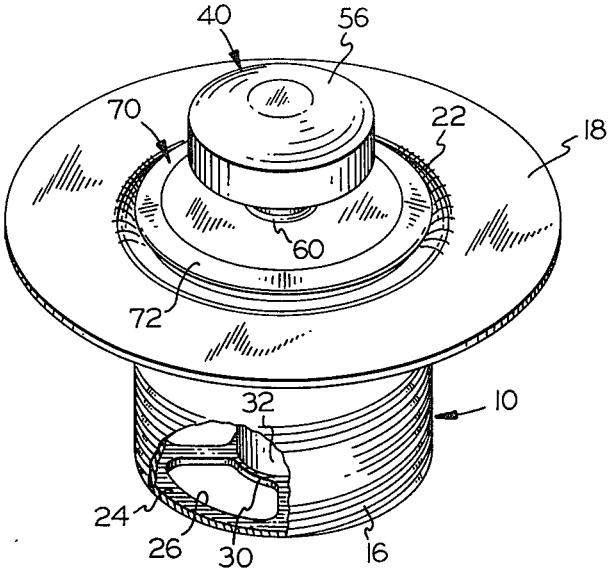
FIG. 1 is a perspective view of a strainer embodying the present invention, with a portion of the sidewall broken away to expose the end wall thereof.
Figure 2:
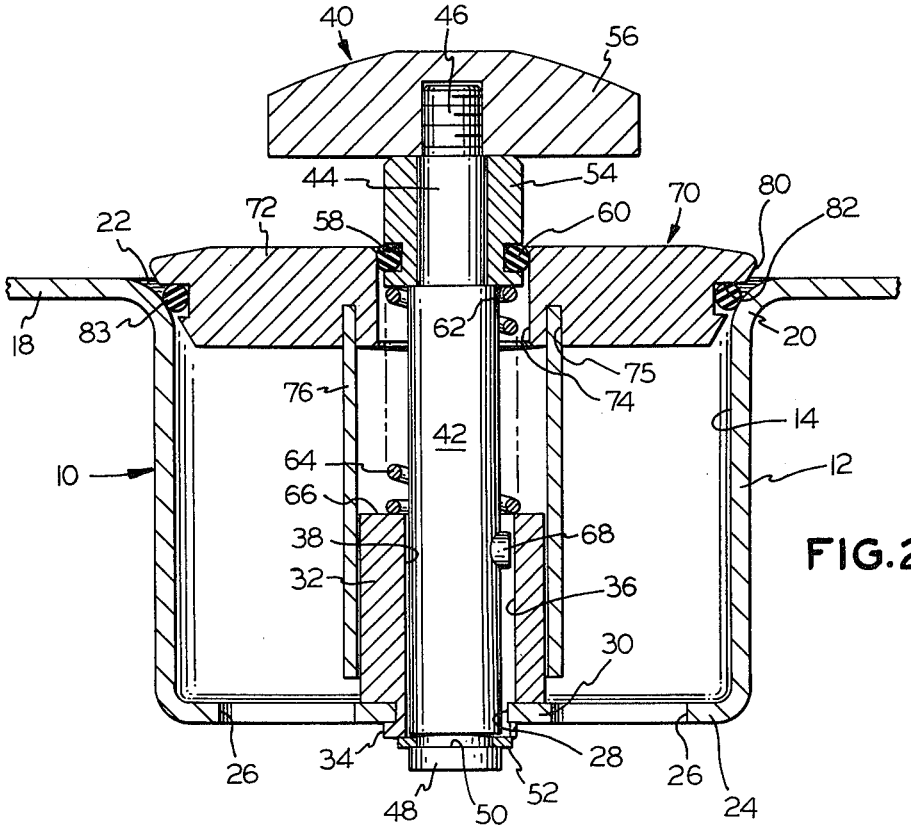
FIG. 2 is a cross-sectional view taken at a plane through the axis of the strainer, and drawn to an enlarged scale.
Figure 3:
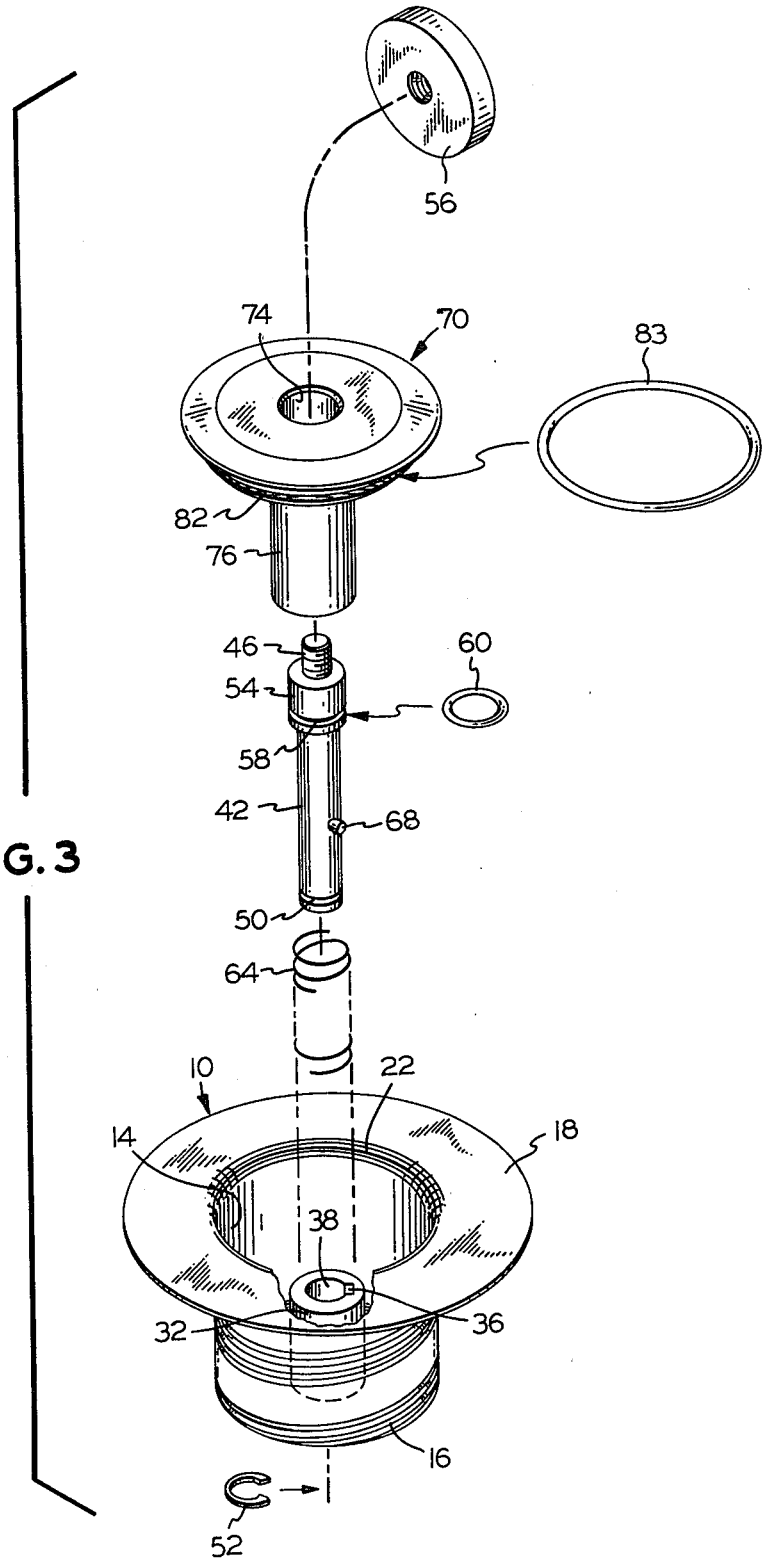
FIG. 3 is an exploded perspective view of the strainer of FIG. 1, drawn to a slightly diminished scale.

Turning now in detail to FIGS. 1–3 of the drawings, therein illustrated is a strainer embodying the present invention and including an integrally formed metal body, generally designated by the numeral 10. The body 10 comprises a cylindrical sidewall 12 defining a passageway 14 therethrough, and it has an externally threaded portion 16 for engagement with a standard, internally threaded drain pipe (not shown). An annular flange 18 extends about the sidewall 12 of the body 10 adjacent the inlet end of the passageway 14, and it is joined thereto by a rounded, circumferential transition portion 20, the latter providing a seat portion and sealing surface 22. A spider, or end wall, 24 spans the outlet end of the sidewall 12, and is formed with large openings 26 to permit the unimpeded flow of liquid through the passageway 14. A primary function of the spider 24 is to support the operating portions of the strainer, as will be described presently.

A centrally located aperture 28 is formed in the hub portion 30 of the spider 24, and an upstanding stem bushing 32 is secured therein. For that purpose, the lower end 34 of the bushing 32 is of reduced cross-section, and is upset against the outside surface of the hub portion 30; although not shown, the aperture 28 has a flat, which cooperates with the bushing end 34 to prevent relative rotation of the parts. An axially extending slot 36 is formed in the surface defining the bore 38 through the bushing 32, for a purpose to be described below.

A plunger, generally designated by the numeral 40, is slideably mounted in the bushing 32, and comprises a stem 42 having a reduced diameter upper end portion 44 and a threaded tip 46. The lower end portion 48 of the stem 42 projects outwardly through the bushing 32 and the spider 24, and it has a circumferential groove 50 in which is received a retaining ring 52, by which the plunger 40 is secured against disengagement in the outward direction. A second bushing 54 is mounted upon the reduced upper end portion 44 of the stem 42, and an enlarged head, or press top, 56 is threadably engaged upon the tip 46. The bushing 54 has a circumferential groove 58 formed thereabout, and an O-ring 60 is retained therein. Its inner end forms a shoulder at the intersection with the shaft 42, and provides an abutment surface 62 for one end of the coil spring 64, which is mounted on the shaft 42; the opposite end of the spring 64 bears upon the inner end surface 66 of the stem bushing 32. A small lug 68 projects radially from the stem 42 into sliding engagement in the slot 36 of the bushing 32, thus locking the stem against rotation and permitting facile assembly and removal of the head 56.

The stopper member or assembly, generally designated by the numeral 70, consists of a disk-shaped stopper 72 having an axial bore 74 and a coaxial circular groove 75 into which is press-fit a cylindrical sleeve 76. A beveled, inwardly tapered circumferential edge portion 80 is provided on the stopper 72, into which is formed a circumferential groove 82. Seated within the groove 82 is a relatively large diameter O-ring 83, which cooperates to ensure close-fitting sealing engagement of the conical surface 80 against the surface 22 of the body 10. The sleeve 76 is telescopically engaged over the stem bushing 32, thus cooperating with the upper bushing 54 to maintain proper alignment of the stopper assembly 70.

It will be appreciated that, as shown in FIGS. 1–3, the strainer is in its closed condition, with the O-rings 60, 83 sealing it against the flow of liquid through the passageway 14 and bore 74. Operation to open the passageway 14 for maximum flow is illustrated in FIGS. 4 and 5 (full line representations).

Figure 4:
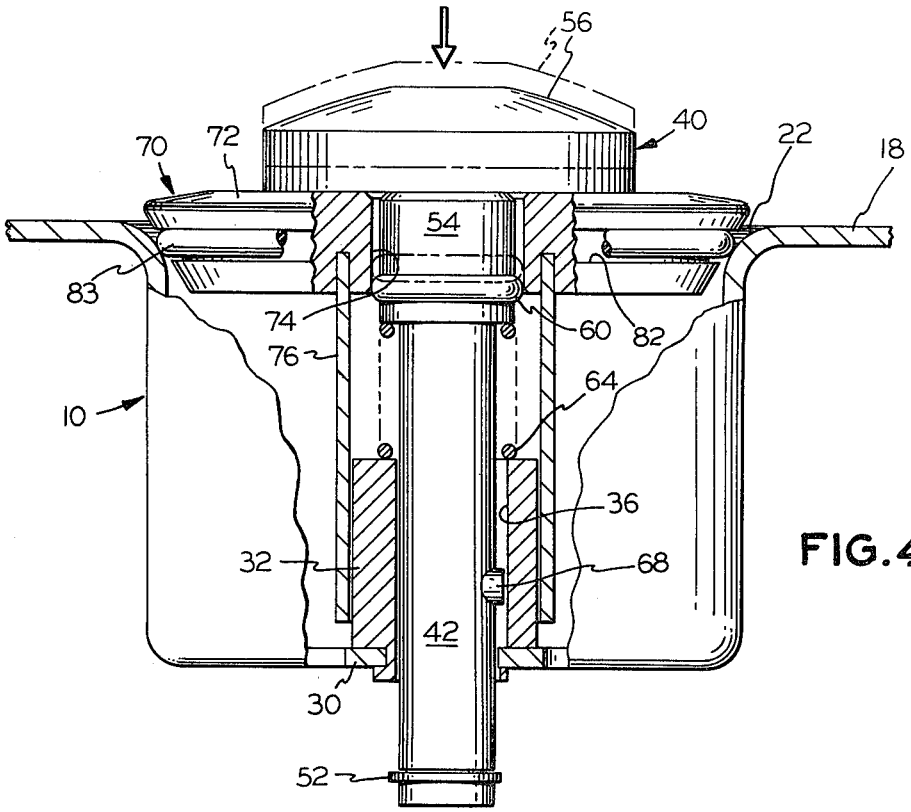
FIG. 4 is a fragmentary elevational view of the strainer in partial section, drawn to the scale of FIG. 2 and showing the plunger fully and partially depressed, in full and phantom line, respectively.

More particularly, in FIG. 4 the plunger 40 has been fully depressed, bringing the head 56 into contact with the stopper 72. The smaller O-ring 60 has thereby been displaced to a point adjacent the inner end of the bore 74, frictionally engaging the plug 72 thereat. Upon release of pressure, the spring 64 will force the plunger 40 outwardly to its fully extended position, in turn lifting the stopper 72 away from the seat 22 on the body 10, and thereby opening the strainer; this will, of course, permit the liquid contained in the vessel to flow through the passageway 14 and into the drainage system.

Figure 5:
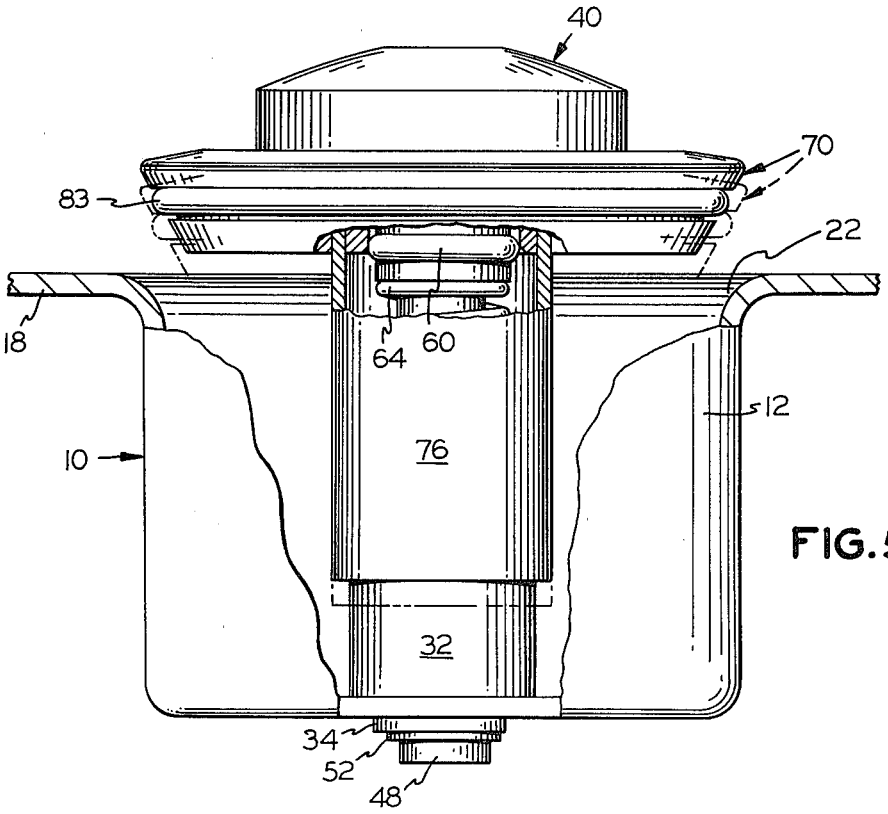
FIG. 5 is a view similar to that of FIG. 4, showing the plunger fully extended, and showing the stopper elevated thereby to positions corresponding to those of the plunger in FIG. 4.

From the phantom line representations in FIGS. 4 and 5, it will be appreciated that the stopper 72 may be maintained in any position between the extremes (i.e., fully open or fully closed), by virtue of the binding force provided by the O-ring 60. This may be achieved either by partial depression of the plunger 40 to effect initial opening (as in FIG. 4), or by adjustment of the stopper 72 after the strainer has been brought to a fully open position. Obviously, this can be done simply by sliding the stopper 72 on the stem 42 to adjust the gap to that at which the desired rate of flow is achieved. Perhaps it should be noted that, in the extreme positions of the plunger 40 relative to the stopper 72, the O-ring 60 may pass to a point at which it is nearly removed from the bore 74; the plug 72 has slightly beveled or relieved edges at the ends of the bore 74 to facilitate movement of the O-ring 60 thereinto from such extreme positions. It is, however, to be appreciated that the O-ring 60 should not be positioned to permit its complete withdrawal outwardly from the bore 74, since undesirable leakage at that location would tend to result.

Figure 6:
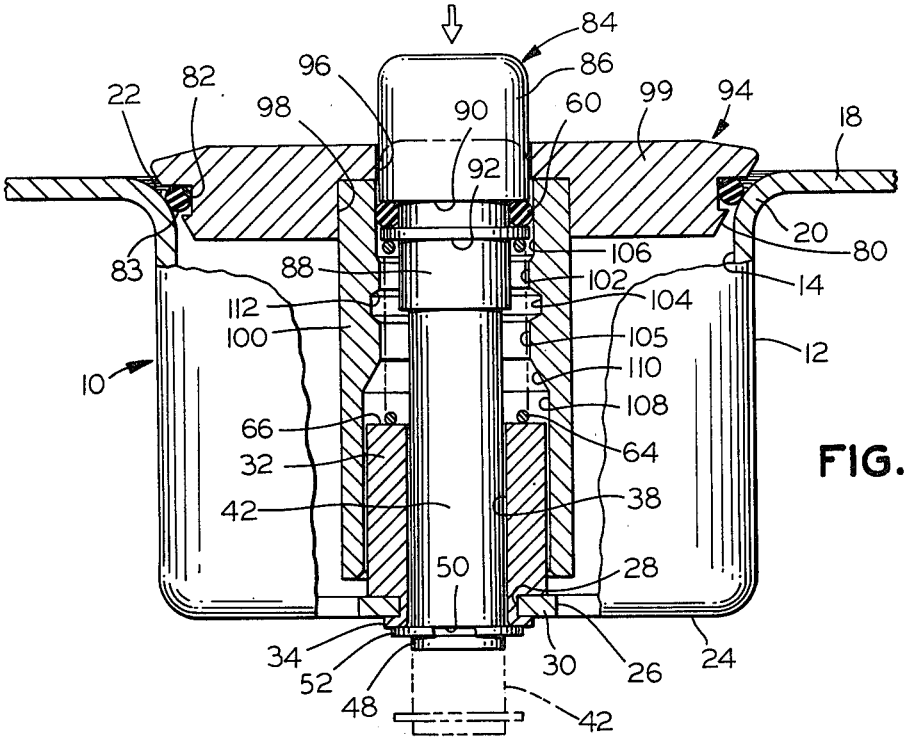
FIG. 6 is a fragmentary elevational view of a second strainer embodying the present invention, shown in partial section and depicting the plunger in its fully elevated and depressed positions, in full and phantom line, respectively.
Figure 7:
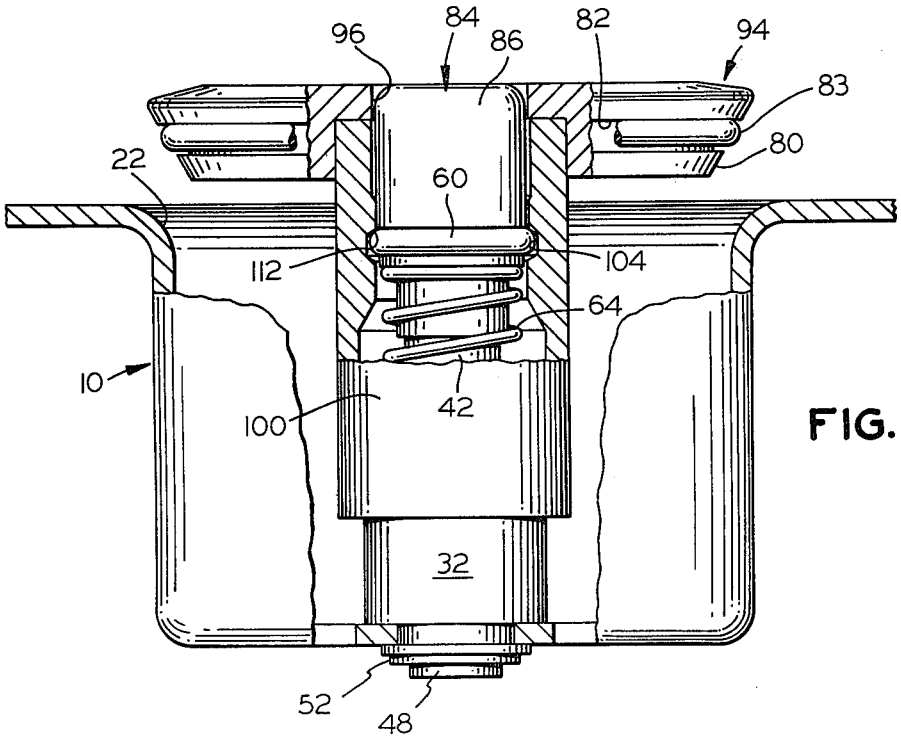
FIG. 7 is a view similar to that of FIG. 6, showing the plunger fully extended and the stopper elevated by engagement therewith.

A second (and in some respects preferred) embodiment of the invention is shown in FIGS. 6 and 7, wherein parts and elements common to the previously described embodiment are given the same numbers as were used in connection therewith. In this embodiment, the plunger, which is generally designated by the numeral 84, is of unitary construction. It has an enlarged head portion 86, and a neck portion 88 which is of a diameter intermediate those of the head 86 and stem 42. An abutment surface 92 for the spring 64 is formed at the intersection of the head portion 86 and neck portion 88, and a circumferential groove 90 is formed in the head portion 86 to seat the sealing O-ring 60. As will be appreciated, the one-piece construction of the plunger 84 is desirable from the standpoint of economy and facility of manufacture; it also obviates any need to secure the parts against relative rotation.

The principal differences between this and the previously illustrated embodiment reside in the construction of the stopper assembly, generally designated by the numeral 94. As can be seen, the stopper 99 has a relatively small diameter bore section 96, and a counterbore portion 98 formed into the underside thereof. A cylindrical sleeve, generally designated by the numeral 100, is press-fit into the counter-bore 98, and is internally configured to provide functional portions for operation of the device.

More specifically, an outer circumferential land defines a throat portion 102, axially outwardly adjacent to which lies an enlarged entry portion 106, and inwardly adjacent to which lies a more greatly enlarged annular recess 108. A second land portion 105 is disposed inwardly adjacent the recess 104, and it opens through a conical section 110 to an enlarged bore portion 108. The upstanding bushing 32 is telescopically received within the bore portion 108, and supports the sleeve 100 for sliding reciprocal movement.

As will be appreciated, in FIG. 6 (full line) the strainer is shown in its closed position. To open it, the plunger 84 is depressed, normally to the point at which the sealing ring 60 snaps into the annular recess 104 (which position is shown in phantom line), providing interfering engagement against the shoulder 112 formed on the underside of the land 102. As in the previous embodiment, release of the applied pressure will permit the spring 64 to force the plunger 84 outwardly, carrying with it the stopper assembly 94 and lifting the stopper 99 away from the seating surface 22; this condition is shown in FIG. 7.

The size of the opening gap may again be varied by partial depression of the plunger, through binding engagement of the O-ring 60 upon the surfaces of either the throat portion 102 or the entry portion 106. However, the snap-fit engagement that occurs when the plunger is depressed sufficiently to bring the sealing ring into registry with the annular recess 104 provides the most positive mode of operation, as may be particularly significant if the internal parts have become soap coated, and hence slippery. The recess 104 also serves to locate the intended innermost position of the plunger 84, since the ring will not move onto the land 105 in the absence of perceptibly increased force. Finally, the primary function of the entry portion 106 of the sleeve bore is to provide a zone of reduced compression in which the sealing ring 60 may relax, thus minimizing any tendency for it to take on a permanently distorted set over a period of time; the need for such a precaution will depend largely upon the inherent long-term resiliency or memory of the material from which the ring 60 is fabricated.

Although strainers of the present sort will generally be of circular cross-section, for ready installation in standard fixtures, noncircular cross-sections may also be feasible for certain applications. Conventional materials of construction will be employed in most instances, and chrome-plated brass parts may advantageously be used for the strainer body, plunger and stopper. While O-rings will usually provide the most effective and convenient means for establishing seals between the relatively movable parts, and for providing the binding or interfering engagement required between the plunger and the stopper, alternatives may occur to those skilled in the art, and may be utilized in the construction of the present strainer, if so desired. It should be noted that, in those instances in which non-interference, binding forces are relied upon for operation, high degrees of compression and large binding forces are nevertheless not required; the preferred levels will normally be those that are just adequate to bind the stopper to the plunger for displacement to, and maintenance of, the desired relative positions. Otherwise, operation of the strainer will tend to be rough and difficult. On the other hand, the O-ring should not generally be free to roll in the associated groove, since positional stability, and hence flow rate control, could be compromised as a result.

Thus, it can be seen that the present invention provides a novel strainer for controlling the flow of liquid through the drain of a tub or similar vessel, which strainer is of relatively simple construction and consists of a limited number of parts, and hence is relatively inexpensive and facile to manufacture. The strainer operates effectively and smoothly between open and closed positions, and it permits relatively unobstructed flow at rates that may readily be varied within the limits of the device. In particular, only a single coil spring need be used, and the unit requires no plunger restraining or locking mechanism, such as would preclude variable flow rates and, by its size, would tend to unduly obstruct free passage of the liquid therethrough. The strainer is convenient to install and operate, it is attractive, and it is readily disassembled for cleaning or for replacement of the sealing members, if necessary.

Having thus described the invention, what is claimed is:

1. A strainer for controlling liquid flow through the drain of a tub or similar vessel, comprising: a body defining an axial passageway and having a seat portion providing a sealing surface adjacent the inlet end thereof; a plunger having a stem extending into said passageway and mounted on said body for axial reciprocation between an extended outward position and a depressed inward position; means for biasing said plunger to said outward position; stopper means slideably mounted on said plunger stem and having a stopper aligned over said seat portion of said body for seating thereon to close said strainer, said stopper having an outer peripheral edge portion adapted to sealingly engage said sealing surface of said body when said stopper is in said seated position, said stopper means having an axial bore with a surface portion dimensioned and configured to conform to the corresponding portion of said plunger stem; and a resiliently deformable sealing ring fixedly mounted on and extending about said plunger stem portion at a position spaced inwardly from the outer end of said stem; whereby said strainer may be opened from its closed condition by depressing and then releasing said plunger, inward movement of said plunger causing said sealing ring to be displaced to a position of binding engagement on said bore surface portion, and subsequent outward movement under the force of said biasing means causing said plunger to lift said stopper means and to displace said stopper from said seat portion of said body.

2. The strainer of claim 1 wherein said body comprises a cylindrical sidewall defining said passageway, and a perforate end wall extending across the inner end of said sidewall, said stem of said plunger projecting through said end wall and being slideably engaged therein, with means on the projecting end portion thereof preventing movement of said plunger beyond said extended outward position.

3. The strainer of claim 2 wherein the outer end of said sidewall terminates in an annular flange joined to said sidewall by a circumferential transition edge portion of rounded cross-section, said transition edge portion providing said seat portion and sealing surface of said body.

4. The strainer of claim 2 additionally including a bushing rigidly fixed to and projecting axially from said end wall of said body toward said inlet end of said passageway, and a sleeve element rigidly affixed to and projecting axially from said stopper toward said end wall, said sleeve element extending into telescopic engagement over said bushing with said stem of said plunger extending coaxially through the bore thereof.

5. The strainer of claim 4 wherein said bushing has an axially extending slot formed in the surface defining said bore thereof, wherein said stem has a radially projecting lug slideably received in said slot, and wherein said plunger includes a head member threadably engaged upon said outer end of said stem, said bushing locking said stem against rotation by engagement of said lug in said slot, to facilitate threadable engagement and disengagement of said plunger head member.

6. The strainer of claim 4 wherein said biasing means is a coil spring and wherein said corresponding portion of said shaft is enlarged relative to the remaining portions thereof, and thereby provides a circumferential shoulder therebetween, said spring being mounted on said shaft within said sleeve element and being compressed between said corresponding portion of said stem and said bushing, the opposite ends of said spring bearing upon said shoulder and upon a confronting end of said bushing.

7. The strainer of claim 1 wherein said bore through said stopper means and said bore surface portion lie substantially within said stopper and are of uniform circular cross-section, and wherein said corresponding portion of said plunger stem is cylindrical, said stem portion having a diameter slightly less than that of said bore, to provide a substantially uniform gap between said stem portion and said bore surface portion, and having a circumferential groove formed therein for mounting of said first-mentioned sealing ring, said groove being disposed to position said first-mentioned sealing ring in sealing engagement with said bore surface adjacent the outer end thereof when said stopper and plunger are in said seated and outward positions thereof, respectively, and said sealing ring effecting binding frictional engagement on said bore surface portion in said displaced position thereof.

8. The strainer of claim 1 wherein said sidewall has an external threaded portion.

9. The strainer of claim 1 wherein said stopper is of generally disk-shaped configuration, and is circumferentially beveled to provide a downwardly tapered conical surface for seating upon said seat portion of said body.

10. The strainer of claim 9 wherein said conical surface has a circumferential groove formed therein, and wherein a sealing ring is retained within said groove.

11. The strainer of claim 1 wherein said stopper member additionally includes a sleeve element rigidly affixed to and projecting axially inwardly from said plug, said sleeve element at least in part defining said axial bore through said stopper member, and said conforming surface portion thereof.

12. The strainer of claim 11 wherein said bore lies substantially within said sleeve element and is of circular cross-section, and wherein said corresponding portion of said bore surface portion comprises an annular enlargement formed coaxially into said sleeve element at a location spaced from the outer end thereof, and a circumferentially constricted throat portion outwardly adjacent to said annular enlargement, said throat portion being dimensioned to compress said sealing ring and said annular enlargement being dimensioned to permit its substantial expansion, when said sealing ring is in respective registry therewith, whereby said enlargement provides a position of snap-fitting interfering engagement for said sealing ring in an inwardly displaced position thereof.

13. The strainer of claim 12 wherein said bore has a second constricted portion inwardly adjacent said annular enlargement to restrain inward displacement of said plunger beyond the point of engagement of said sealing ring within said enlargement.

14. The strainer of claim 12 wherein said bore has an enlarged entry portion outwardly adjacent said throat portion, said sealing ring being expandable to substantially its full extent to effect sealing engagement within said entry portion of said bore.

15. The strainer of claim 11 wherein said body comprises a cylindrical sidewall defining said passageway, and a perforate end wall extending across the inner end of said sidewall, said strainer additionally including a bushing rigidly fixed to and projecting axially from said end wall of said body toward said inlet end of said passageway, said sleeve element extending into telescopic engagement over said bushing with said stem of said plunger extending coaxially through the bore of the latter.

16. The strainer of claim 15 wherein said biasing means is a coil spring and wherein said corresponding portion of said shaft is enlarged relative to the remaining portions thereof, and thereby provides a circumferential shoulder therebetween, said spring being mounted on said shaft within said sleeve element and being compressed between said corresponding portion of said stem and said bushing, the opposite ends of said spring bearing upon said shoulder and upon a confronting end of said bushing.

* * * * *